US007398561B2

(12) United States Patent
Kim et al.

(10) Patent No.: US 7,398,561 B2
(45) Date of Patent: Jul. 15, 2008

(54) DEVICE FOR OPENING-CLOSING JAW GUARD OF HELMET

(75) Inventors: Young-Il Kim, Gunpo-si (KR); Chang-Seob Lee, Yongin-si (KR); Dal Busco Giacomo, Montebelluna (IT)

(73) Assignee: HJC. Co., Ltd. (KR)

( * ) Notice: Subject to any disclaimer, the term of this patent is extended or adjusted under 35 U.S.C. 154(b) by 396 days.

(21) Appl. No.: 11/335,869

(22) Filed: Jan. 19, 2006

(65) Prior Publication Data

US 2007/0136934 A1 Jun. 21, 2007

(30) Foreign Application Priority Data

Dec. 15, 2005 (KR) ..... 10-2005-0124126

(51) Int. Cl.
*A42B 1/08* (2006.01)

(52) U.S. Cl. ..... 2/424

(58) Field of Classification Search ..... 2/424, 2/410, 411, 425, 422, 10
See application file for complete search history.

(56) References Cited

U.S. PATENT DOCUMENTS 4,397,047 A * 8/1983 Nava ..... 2/424
4,794,652 A * 1/1989 Piech von Planta et al. ..... 2/414
5,062,162 A * 11/1991 Kamata ..... 2/424
5,185,889 A * 2/1993 Kamata ..... 2/424
5,901,369 A * 5/1999 Pilney ..... 2/6.5
6,237,161 B1 * 5/2001 Lee ..... 2/414
6,249,918 B1 * 6/2001 Lacroix ..... 2/424
6,598,238 B2 * 7/2003 Hong et al. ..... 2/424
6,654,969 B2 * 12/2003 Taniuchi ..... 2/424
6,711,753 B2 * 3/2004 Arai ..... 2/424
6,892,400 B1 * 5/2005 Choi et al. ..... 2/424
7,024,704 B2 * 4/2006 Gafforio et al. ..... 2/424
7,065,798 B2 * 6/2006 Kuo ..... 2/424
7,210,174 B2 * 5/2007 Yeh ..... 2/424
2003/0182716 A1 * 10/2003 Wu ..... 2/424

* cited by examiner

*Primary Examiner*—Danny Worrell
(74) *Attorney, Agent, or Firm*—R. Neil Sudol; Henry D. Coleman; William J. Sapone

(57) ABSTRACT

A device for opening-closing jaw guard of a helmet is disclosed. The device has a hinge means 400 comprising fixed plates 410 which are fixed on both the left and right sides of the helmet body 1 and each of which has a long hole 411, operating plates 420 which are fixed on the inside of the left and right extending portions 4*a* of the jaw guard 4 and each of which has an arc-shaped internal gear 421, a planetary gear 430 which is engaged with the internal gear 421 of the operating plate 420, and has a protuberance 431 formed on either side, and a cutaway portion 432 formed on the outer circumference; and a pivoting lever 440 which has a shaft protuberance 441 of front end inserted into the cutaway portion 432 of the planetary gear 430 and a penetration hole 442 of rear end inserted into the main boss 423 of the operating plate 420.

5 Claims, 6 Drawing Sheets

【Fig. 1】
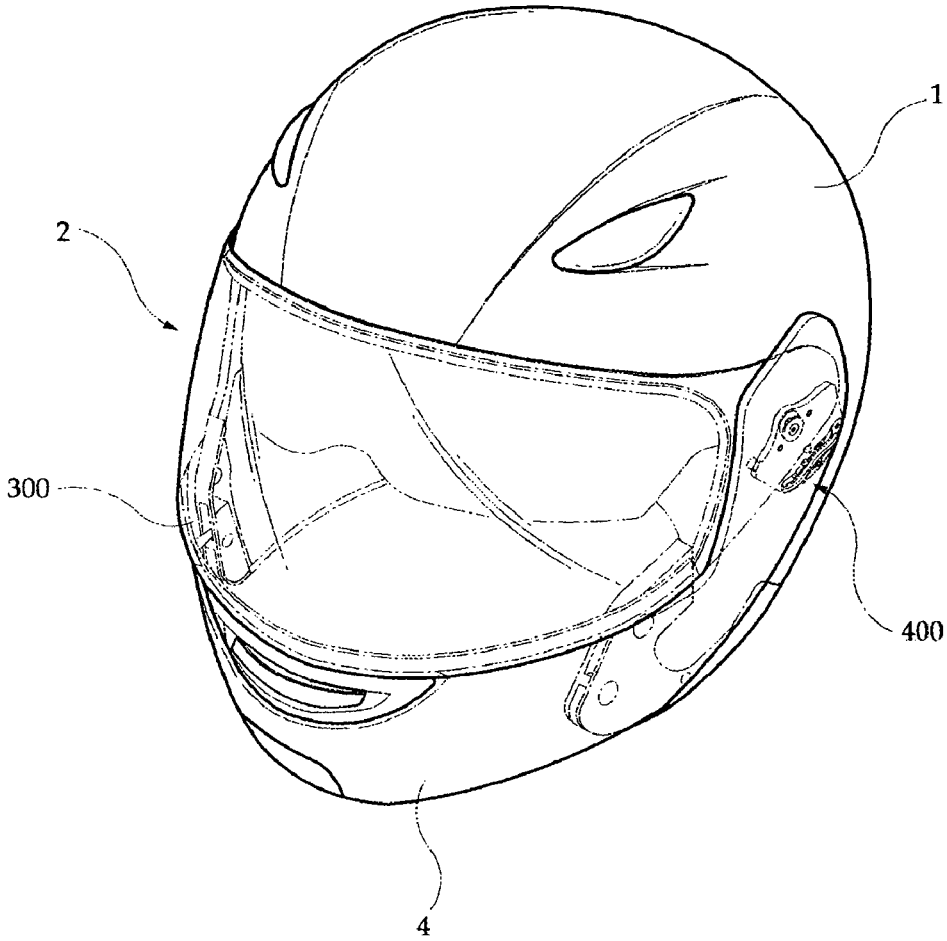

【Fig. 2】
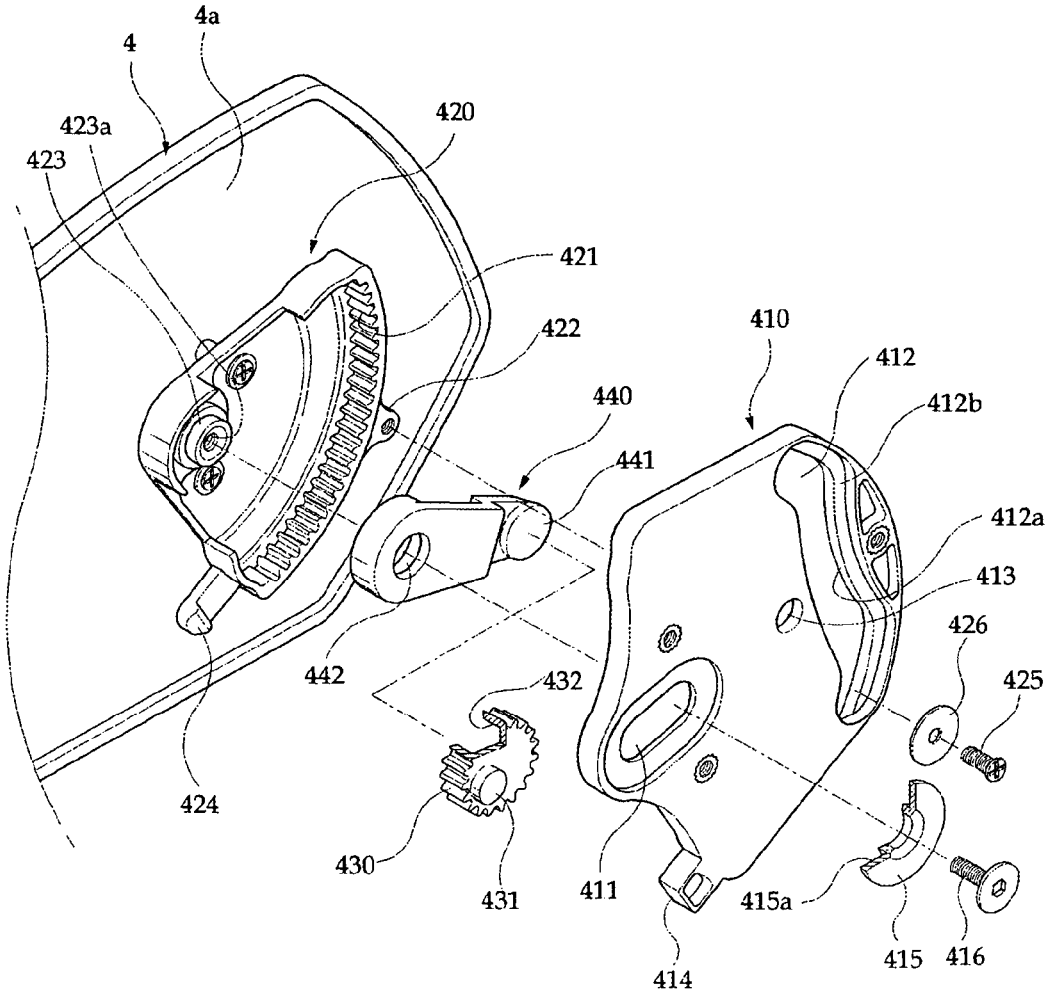

【Fig. 3】
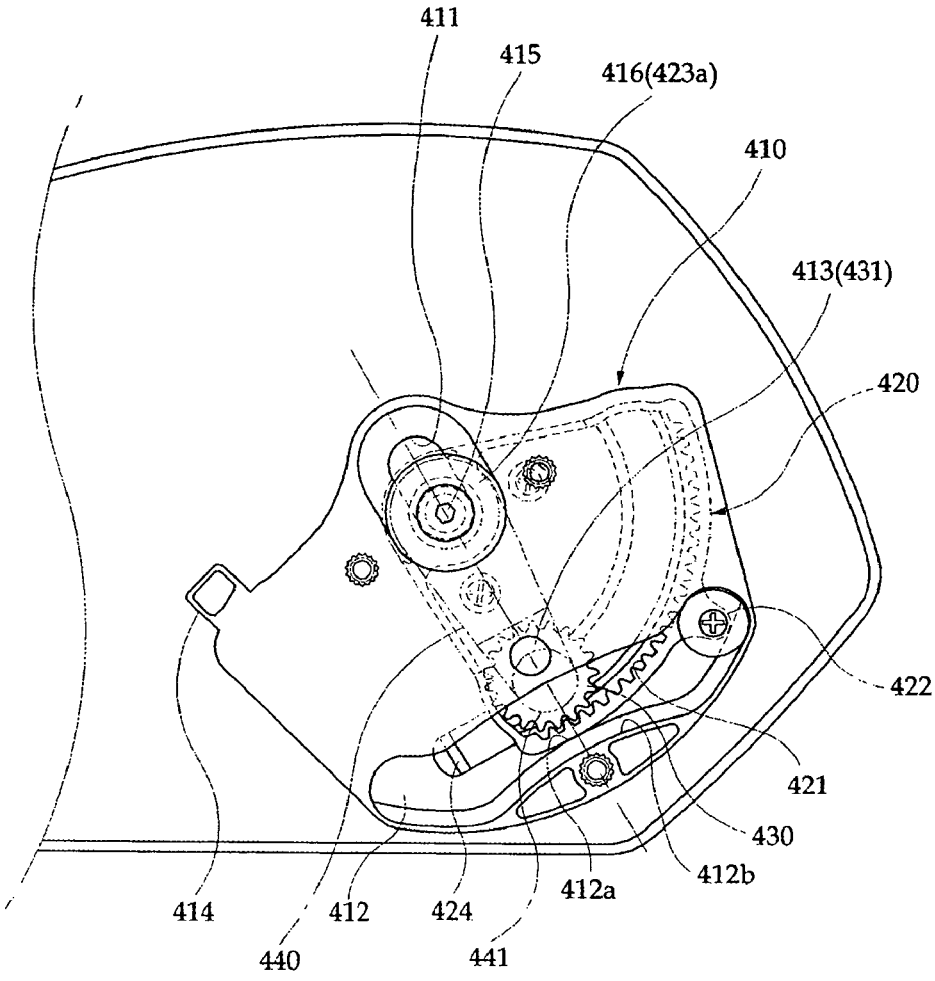

【Fig. 4】
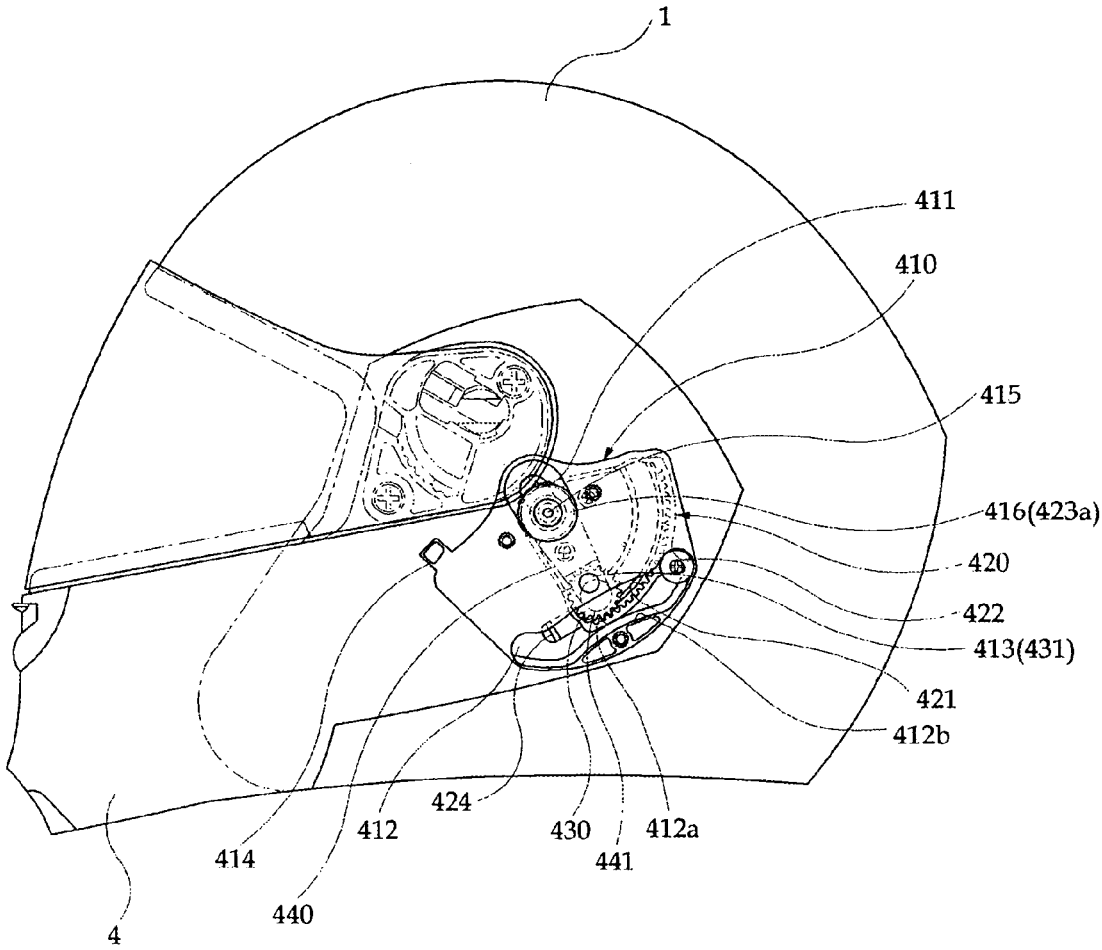

【Fig. 5】
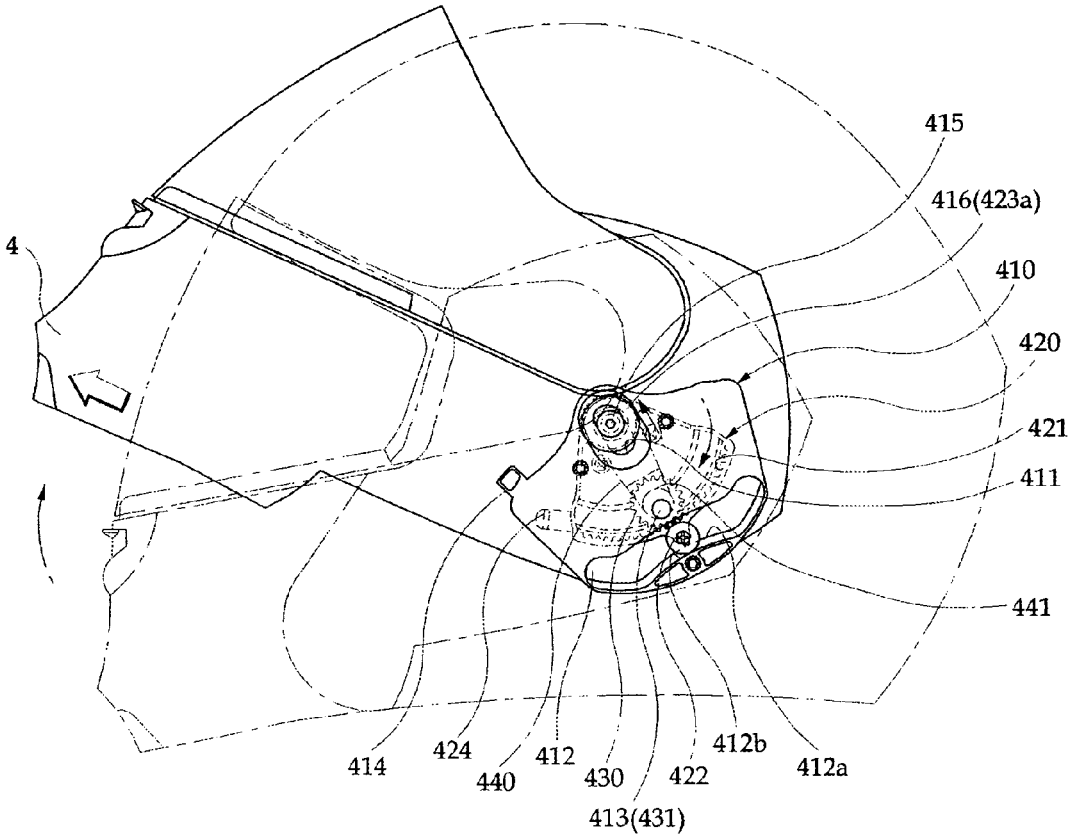

【Fig. 6】
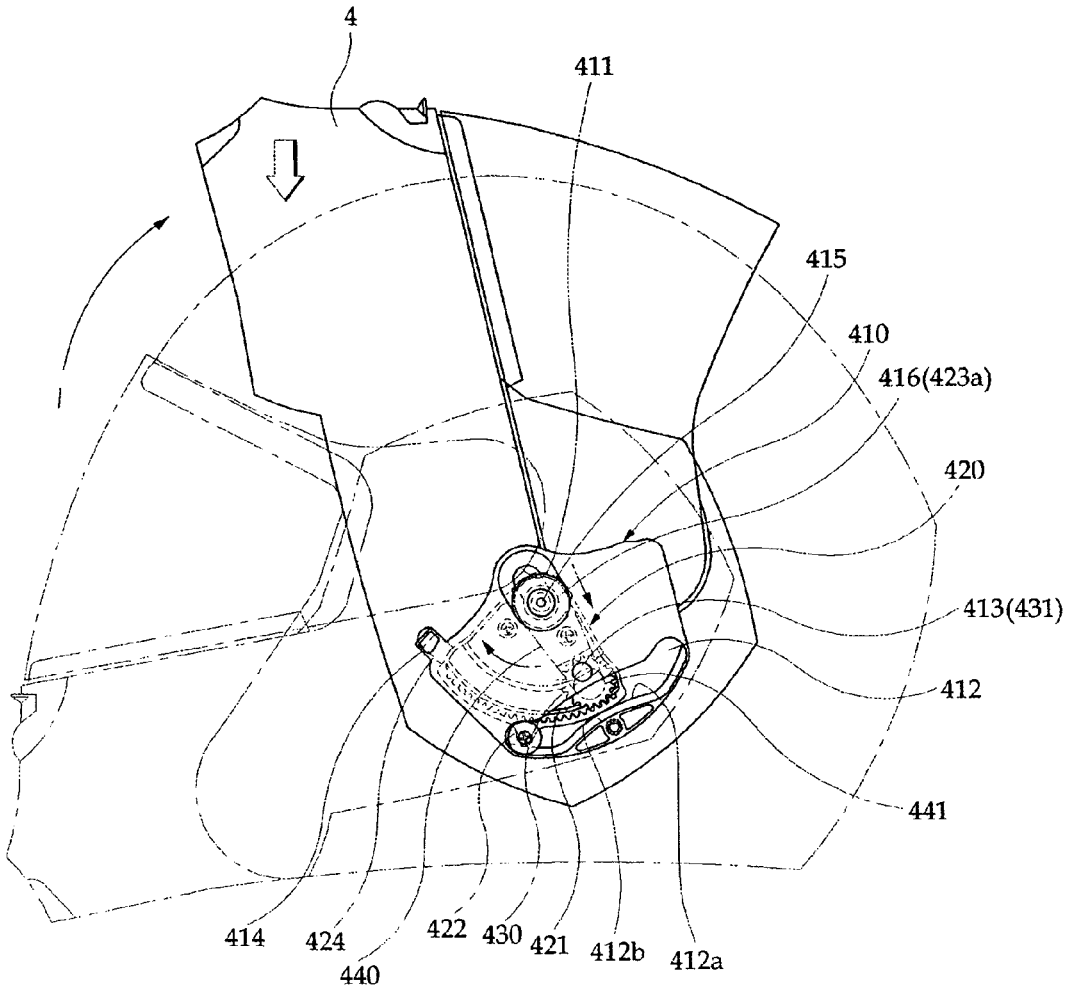

DEVICE FOR OPENING-CLOSING JAW GUARD OF HELMET

BACKGROUND OF THE INVENTION

1. Field of the Invention

The present invention relates to a device for opening-closing jaw guard of a helmet, and more specifically to a device for opening-closing jaw guard of a helmet which can improve the appearance of the helmet by making the jaw guard operate without interference with other parts of the helmet in the process of opening and closing the jaw guard.

2. Description of the Related Art

In general, a motorcycle helmet has an opening portion for securing the field of vision ahead, and there are a full-face type in which the jaw guard portion below is in one body and an opening-closing type in which the jaw guard can be opened and closed.

The jaw guard of the opening-closing type of a helmet in which the jaw guard can be opened and closed goes up to the top of head when it is turned up, and when it is turned down to be closed, the locking mechanism is locked and at the same time it is fixed in close contact to the front of the jaw.

The pivoting of such a conventional opening-closing jaw guard is made on hinge shafts provided as fulcrum on both the left and right sides of the helmet. But in the conventional helmet, just simple pivot action only is allowed, so it has a drawback that the jaw guard being opened or closed interferes with the front of the helmet or other attachments such as vent parts.

In other words, because the occasionally opened and closed jaw guard grazes other parts of the helmet when it is opened and closed, the grazing makes the appearance bad and sometimes causes the lifetime of the helmet to shorten.

SUMMARY OF THE INVENTION

Therefore, it is an object of the present invention to provide a device for opening-closing jaw guard of a helmet which can protect the appearance of the helmet by preventing interference and friction with the jaw guard of the helmet by improving the hinge structure of the jaw guard so that it pivots in a condition floated at a predetermined distance from the helmet.

In accordance with the present invention, there is provided a device for opening-closing jaw guard of a helmet fitted on the helmet body which is provided with an opening portion for the face in front to protect the jaw of the wearer by blocking part of the opening portion by a hinge means, the hinge means comprising: fixed plates which are fixed on both the left and right sides of the helmet body and each of which has a long hole, an arc-shaped guide hole formed away from the long hole at a predetermined interval, and a fixed plate having a wheel hole formed between these holes; operating plates which are fixed on the inside of the left and right extending portions of the jaw guard and each of which has an arc-shaped internal gear, an upward guide protuberance formed on the outside of the internal gear, and a main boss formed in the central position of the arc of the internal gear; a planetary gear which is engaged with the internal gear of the operating plate, and has a protuberance formed on either side, and a cutaway portion formed on the outer circumference; and a pivoting lever which has a shaft protuberance of front end inserted into the cutaway portion of the planetary gear and a penetration hole of rear end inserted into the main boss of the operating plate.

Preferably, the upward guide protuberance of the pivoting lever is slidably inserted into the arc-shaped guide hole of the fixed plate, and a protruded portion formed in the direction opposite to the arch is provided on the midway circumference of the arc-shaped guide hole, so that the main boss can pivot sliding lengthwise of the long hole during the pivoting of the jaw guard.

Preferably, the hinge means further comprises a stopper formed on one side of the operating plate for providing a pivot stopping point of the jaw guard, and an engaging portion corresponding to the stopper formed on one side of the fixed plate.

Preferably, in order to maintain close contact between the fixed plate and the operating plate, a bush having a flange is inserted into the long hole, and a main screw inserted through the center of the bush is screwed to the screw hole of the main boss.

Preferably, the fixed plate and the operating plate operate, while a washer of a sub screw fastened to the upward guide protuberance is placed on the stepped portion formed along the arc-shaped guide, to maintain close contact each other.

BRIEF DESCRIPTION OF THE DRAWINGS

Other objects and aspects of the present invention will become apparent from the following description of embodiments with reference to the accompanying drawings in which:

FIG. 1 is a perspective view of a helmet fitted with a jaw guard of the present invention;

FIG. 2 is an exploded perspective view showing the configuration of the hinge portion of the present invention;

FIG. 3 is a detail view of the hinge portion of the jaw guard of the present invention;

FIG. 4 is a side view showing the condition before operation of the jaw guard of the present invention;

FIG. 5 is a side view showing the condition during operation of the jaw guard of the present invention;

FIG. 6 is a side view showing the condition after operation of the jaw guard of the present invention.

DESCRIPTION OF THE PREFERRED EMBODIMENT

Below will be described in detail a device for opening-closing jaw guard of a helmet according to the present invention with reference to the accompanying drawings.

FIG. 1 is a perspective view of a helmet fitted with a jaw guard of the present invention, and FIG. 2 is an exploded perspective view showing the configuration of the hinge portion of the present invention.

As shown in these drawings, the helmet of the present invention includes a jaw guard 4 which is fitted on the helmet body 1 that is provided with an opening portion 2 in front for the face to protect the jaw of the wearer by covering the lower portion of the opening 2. The jaw guard 4 maintains locking condition by a locking means 300, while it is opened or closed by a hinge means 400 pivoting around the hinge shaft.

As shown in FIG. 2, the hinge means 400 of the present invention comprises a fixed plate 410, an operating plate 420, a planetary gear 430 and a pivoting lever 440.

First, each of the fixed plates 410 fixed on the left and right sides of the helmet body 1 has a long hole 411, an arc-shaped guide hole 412 formed away from the long hole 411 at a predetermined interval, and a wheel hole 413 formed between these holes 411 and 412.

And each of the operating plates 420 fixed on the inside of the left and right extending portions 4*a* of the jaw guard 4 has an arc-shaped internal gear 421, an upward guide protuberance 422 formed on the outside of the internal gear 421, and a main boss 423 formed in the central position of the arc of the internal gear 421.

In addition, the planetary gear 430 engaged with the internal gear 421 of the operating plate 420 has a protuberance 431 formed on either side and a cutaway portion 432 formed on the outer circumference.

Also, the pivoting lever 440 has a shaft protuberance 441 of front end inserted into the cutaway portion 432 of the planetary gear 430 and a penetration hole 442 of rear end inserted into the main boss 423 of the operating plate 420.

As shown in FIG. 3, the upward guide protuberance 422 of the pivoting lever 440 slidably inserted into the arc-shaped guide hole 412 of the fixed plate 410 and a protruded portion 412*a* is formed on the midway inner circumference of the arc-shaped guide hole 412 in the direction opposite to the arc, so that the main boss 423 can pivot sliding lengthwise of the long hole 411 when the jaw guard 4 is pivoting.

And, since the fixed plate 410 and the operating plate 420 have to operate with the planetary gear 430 and the pivoting lever 440 inserted between them, they have to maintain close contact each other.

For this, a bush 415 having a flange 415*a* is inserted into the long hole 411, and a main screw 416 inserted through the center of the bush 415 is joined to a screw hole 423*a* of the main boss 423. Also, on a stepped portion 412*b* formed along the arc-shaped guide hole 412, a washer 426 of a sub screw 425 fastened to the upward guide protuberance 422 is placed for operating.

And, on one side of the operating plate 420 is formed a stopper 424 for providing a pivot stopping point of the jaw guard 4, and on one side of the fixed plate 410 is formed an engaging portion 414 corresponding to the stopper 424.

Next will be described the operation of the device for opening-closing jaw guard of the present invention configured like this.

FIGS. 4 to 6 are partial side views showing the conditions before, after and during operation of the jaw guard of the present invention, respectively.

First, when the user with the helmet on lifts up the jaw guard 4 while pushing the unlock lever of the locking means 30, the locking condition of the locking means 300 is released to enable him to lift up the jaw guard 4.

Like this, at the point of time when the jaw guard 4 begins to be lifted up, pivoting becomes possible for the jaw guard 4 with the fulcrum on the main screw 416 that is joined to the screw hole 423*a* after penetrating the long hole 411 through the bush 415.

At this time, as shown in FIG. 4, the planetary gear 430 is positioned at the bottom end of the internal gear 421 of the operating plate 420, and the bush 415 is positioned on the lower side of the long hole 411.

When the jaw guard 4 is lifted up further, the operating plate 420 is also rotated accordingly, as shown in FIG. 5. Because of that, the planetary gear 430 comes gradually to the midway point of the internal gear 421 of the operating plate 420 being pivoted. When the planetary gear 430 moves like that and reaches the center of the internal gear 421, the upward guide protuberance 422 goes up to the top dead center of the protruded portion 412*a* in the arc-shaped guide hole 412.

When the upward guide protuberance 422 climbs the protruded portion 412*a* of the arc-shaped guide hole 412, the bush 415 inserted into the fixed plate 410 by the main screw 416 moves to the top side of the long hole 411. As a result, as shown in FIG. 5, the jaw guard 4 is opened with the operating plate 420 toward the jaw guard 4 with respect to the fixed plate 410 being lifted up outward (in the direction of the jaw guard 4 floating up from the helmet).

As the planetary gear 430 moves further toward the top end of the internal gear 421 of the operating plate 420, the upward guide protuberance 422 goes down from the protruded portion 412*a* of the arc-shaped guide hole 412. Accordingly, since the bush 415 moves to the lower side of the long hole 411, the height when the jaw guard 4 is opened completely is maintained as well when it is lowered toward the helmet again, as shown in FIG. 6.

Through such an operating process, the jaw guard 4 is opened, and when it is closed, it proceeds in reverse order of the operating process for opening.

And, in the condition of the jaw guard 4 opened completely, the opened condition can be maintained because the stopper 424 of the operating plate 420 is caught in the engaging portion 414 of the fixed plate 410, as shown in FIG. 6.

While it is being opened and closed like this, the jaw guard 4 including the operating plate 420 is lifted up, by the upward guide protuberance 422 passing the protruded portion 412*a* of the arc-shaped guide hole 412, and by the main screw 416 inserted through the bush 415 installed so as to move along the long hole 411, to be opened and closed while being lifted up again, so it can be operated without interference with the helmet body 1.

As described above in detail, since the device for opening-closing jaw guard of a helmet according to the present invention is opened while the jaw guard is being lifted up in the direction going away from the helmet body by the operating plate that is making relative motion with respect to the fixed plate and is closed while being lifted again, interference and friction with the jaw guard can be prevented, so the helmet can be used for a long time without damage to the appearance of the helmet.

In addition, since the force of pivoting the jaw guard during the opening-closing operation is transmitted through the epicycle gear and pivoting lever, sudden rise or sudden fall are prevented for smooth opening and closing at all times.

Although the present invention has been described in detail reference to its presently preferred embodiment, it will be understood by those skilled in the art that various modifications and equivalents can be made without departing from the spirit and scope of the present invention, as set forth in the appended claims.

What is claimed is:

1. A device for opening-closing jaw guard of a helmet fitted on the helmet body which is provided with an opening portion for the face in front to protect the jaw of the wearer by blocking part of the opening portion by a hinge means, said hinge means comprising:

fixed plates which are fixed on both the left and right sides of the helmet body and each of which has a long hole, an arc-shaped guide hole formed away from the long hole at a predetermined interval, and a fixed plate having a wheel hole formed between these holes and;

operating plates which are fixed on the inside of the left and right extending portions of said jaw guard and each of which has an arc-shaped internal gear, an upward guide protuberance formed on the outside of the internal gear, and a main boss formed in the central position of the arc of the internal gear;

a planetary gear which is engaged with the internal gear of said operating plate, and has a protuberance formed on either side, and a cutaway portion formed on the outer circumference; and a pivoting lever which has a shaft protuberance of front end inserted into the cutaway portion of said planetary gear and a penetration hole of rear end inserted into the main boss of said operating plate.

2. The device according to claim 1, wherein the upward guide protuberance of said pivoting lever is slidably inserted into the arc-shaped guide hole of said fixed plate, and a protruded portion formed in the direction opposite to the arch is provided on the midway circumference of the arc-shaped guide hole, so that the main boss can pivot sliding lengthwise of the long hole during the pivoting of the jaw guard.

3. The device according to claim 1, wherein the hinge means further comprises a stopper formed on one side of said operating plate for providing a pivot stopping point of said jaw guard, and an engaging portion corresponding to the stopper formed on one side of said fixed plate.

4. The device according to claim 1, wherein in order to maintain close contact between said fixed plate and said operating plate, a bush having a flange is inserted into the long hole, and a main screw inserted through the center of the bush is screwed to the screw hole of the main boss.

5. The device according to claim 1, wherein said fixed plate and said operating plate operate, while a washer of a sub screw fastened to the upward guide protuberance is placed on the stepped portion formed along the arc-shaped guide, to maintain close contact each other.

* * * * *